US010262636B2

(12) United States Patent
Sutton

(10) Patent No.: US 10,262,636 B2
(45) Date of Patent: Apr. 16, 2019

(54) TECHNIQUES FOR MAGNETICALLY MOUNTING A PERCUSSION INSTRUMENT TO A CYMBAL AND RELATED SYSTEMS AND METHODS

(71) Applicant: Avedis Zildjian Co., Norwell, MA (US)

(72) Inventor: Michael Rangel Sutton, Abington, MA (US)

(73) Assignee: Avedis Zildjian Co., Norwell, MA (US)

( * ) Notice: Subject to any disclaimer, the term of this patent is extended or adjusted under 35 U.S.C. 154(b) by 0 days.

(21) Appl. No.: 15/613,055

(22) Filed: Jun. 2, 2017

(65) Prior Publication Data

US 2018/0350332 A1 Dec. 6, 2018

(51) Int. Cl.
*G10D 13/06* (2006.01)

(52) U.S. Cl.
CPC ..... *G10D 13/065* (2013.01)

(58) Field of Classification Search
CPC ..... G10D 13/065
See application file for complete search history.

(56) References Cited

U.S. PATENT DOCUMENTS 3,677,127 A * 7/1972 Garven ..... G10D 13/06 84/402
4,809,581 A * 3/1989 Paiste, Sr. ..... G10D 13/06 84/402
5,934,629 A 8/1999 Peritz
7,323,632 B2 1/2008 Wachter
8,410,348 B1 4/2013 Hsieh
8,729,378 B2 5/2014 Ryan et al.
9,631,652 B2 4/2017 Krol et al.
9,633,634 B2 4/2017 May
(Continued)

FOREIGN PATENT DOCUMENTS

CN 104795060 A 7/2015
GB 2528280 B 1/2016
(Continued)

OTHER PUBLICATIONS

PCTUS2017/035839, Sep. 29, 2017, International Search Report and Written Opinion.

(Continued)

*Primary Examiner* — Kimberly Lockett
(74) *Attorney, Agent, or Firm* — Wolf, Greenfield & Sacks, P.C.

(57) ABSTRACT

According to some aspects, a cymbal system is provided comprising a cymbal, and a percussion instrument magnetically coupled to the cymbal, said magnetic coupling between the percussion instrument and the cymbal provided at least in part by at least one first magnetic component disposed on a lower side of the cymbal, and at least one second magnetic component disposed on an upper side of the cymbal and attached to the percussion instrument, the at least one first magnetic component and at least one second magnetic component being coupled to the cymbal, at least in part, by a magnetic force of attraction between the at least one first magnetic component and the at least one second magnetic component that acts through the cymbal.

20 Claims, 8 Drawing Sheets

(56) References Cited

U.S. PATENT DOCUMENTS

| | | | | |
|---|---|---|---|---|
| 2005/0087019 | A1 | 4/2005 | Face | |
| 2006/0060062 | A1 | 3/2006 | Dyk | |
| 2011/0265633 | A1* | 11/2011 | Coady | G10D 13/065 84/422.3 |
| 2012/0060669 | A1 | 3/2012 | Ryan et al. | |
| 2012/0118130 | A1 | 5/2012 | Field | |
| 2013/0125735 | A1 | 5/2013 | Mori | |
| 2014/0053713 | A1 | 2/2014 | Truchses | |
| 2015/0143979 | A1 | 5/2015 | Field | |
| 2016/0210941 | A1* | 7/2016 | Suitor | G10H 3/146 |
| 2016/0247492 | A1 | 8/2016 | Field | |
| 2016/0372094 | A1 | 12/2016 | Jasperson | |
| 2017/0125004 | A1 | 5/2017 | Sutton | |

FOREIGN PATENT DOCUMENTS

| | | | |
|---|---|---|---|
| TW | 2012-27712 | A | 7/2012 |
| TW | 1479476 | B | 4/2015 |

OTHER PUBLICATIONS

International Search Report and Written Opinion for International Application No. PCT/US2017/035839 dated Sep. 29, 2017.

PCT/US16/60239, Jan. 6, 2017, Invitation to Pay Additional Fees.

PCT/US16/60239, dated Mar. 16, 2017, International Search Report and Written Opinion.

Invitation to Pay Additional Fees for International Application No. PCT/US16/60239 dated Jan. 6, 2017.

International Search Report and Written Opinion for International Application No. PCT/US16/60239 dated Mar. 16, 2017.

[No Author Listed], Meinl MCT Magnetic Cymbal Tuners for Cymbal Dampening. Musician's Friend. http://www.musiciansfriend.com/acessories/meinl-mct-magnetic-cymbal-tuners-for-cymbal-dampening last accessed Jun. 8, 2017. 3 pages.

[No Author Listed], Majid Drums Jingles PEP with Magnet Mount. Music Store. https://www.musicstore.de/en_RS/EUR/Majid-Drums-Jingles-PEP-with-Magnet-Mount/art-DRU0031252-00 last accessed Jun. 8, 2017. 1 page.

* cited by examiner

TECHNIQUES FOR MAGNETICALLY MOUNTING A PERCUSSION INSTRUMENT TO A CYMBAL AND RELATED SYSTEMS AND METHODS

FIELD OF INVENTION

The present application relates generally to systems and methods for magnetically mounting a percussion instrument to a cymbal.

BACKGROUND

During performance, a percussion musician typically arranges a number of different percussion instruments, such as drums, cymbals, bells, etc. in close proximity to the musician. Many of these instruments are played by striking the instrument with a stick or other implement. Other percussion instruments may be played by shaking the instrument, which causes elements of the instrument to strike one another, producing sound.

SUMMARY

According to some aspects, a cymbal system is provided comprising a cymbal, and a percussion instrument magnetically coupled to the cymbal, said magnetic coupling between the percussion instrument and the cymbal provided at least in part by at least one first magnetic component disposed on a lower side of the cymbal, and at least one second magnetic component disposed on an upper side of the cymbal and attached to the percussion instrument, the at least one first magnetic component and at least one second magnetic component being coupled to the cymbal, at least in part, by a magnetic force of attraction between the at least one first magnetic component and the at least one second magnetic component that acts through the cymbal.

According to some aspects, a method is provided comprising magnetically coupling a percussion instrument to a cymbal, the magnetic coupling provided at least in part by at least one first magnetic component disposed on a lower side of the cymbal, and at least one second magnetic component disposed on an upper side of the cymbal and attached to the percussion instrument, the at least one first magnetic component and at least one second magnetic component being coupled to the cymbal, at least in part, by a magnetic force of attraction between the at least one first magnetic component and the at least one second magnetic component that acts through the cymbal.

According to some aspects, a magnetically mountable percussion instrument is provided comprising a first portion, at least one component coupled to the first portion and/or encapsulated by the first portion, the at least one component being free to move relative to the first portion and thereby produce sound by colliding with the first portion and/or others of the at least one component, at least one first magnetic component coupled to the first portion and having a surface field strength of at least 3000 gauss.

The foregoing is a non-limiting summary of the invention, which is defined by the attached claims.

BRIEF DESCRIPTION OF DRAWINGS

Various aspects and embodiments will be described with reference to the following figures. It should be appreciated that the figures are not necessarily drawn to scale. In the drawings, each identical or nearly identical component that is illustrated in various figures is represented by a like numeral. For purposes of clarity, not every component may be labeled in every drawing.

DETAILED DESCRIPTION

Figure 1:
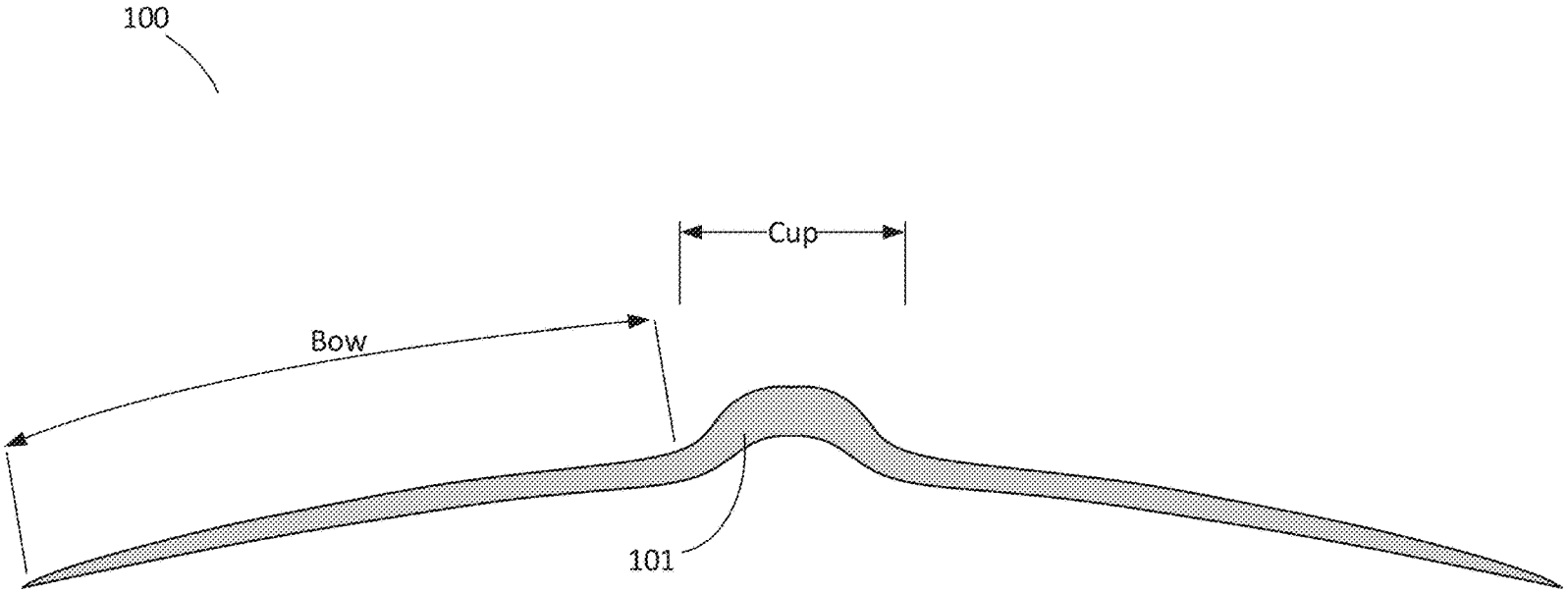
FIG. 1 depicts a cross-section of an illustrative cymbal suitable for practicing some embodiments.

Systems and methods for magnetically mounting a percussion instrument to a cymbal are provided. Some percussion instruments are played by shaking or otherwise moving a first portion of the instrument such that other portions, which can move freely to some extent relative to the first portion, strike some other part of the instrument, producing sound. These types of percussion instruments will be referred to herein as "auxiliary percussion instruments."

In some cases, motion of an auxiliary percussion instrument may cause moveable elements of the instrument to strike one another, such as in the case of a tambourine, which includes metal discs called "jingles" or "zills" that can strike one another to produce sound when the body of the tambourine is moved. In other cases, motion of an auxiliary percussion instrument may cause moveable elements of the instrument to strike one or more non-moveable portions of the instrument, thereby producing sound. For example, maracas and other rattles include small solid pieces inside an enclosed frame that, when moved, causes the pieces to hit the frame and/or each other, producing sound.

In some performance situations, a musician may wish to play different types of percussion instruments at the same time. One traditional combination of different types of percussion instruments is the use of drums and cymbals in the same percussion ensemble. A musician can play both drums and cymbals in this combination by striking either type of instrument with a stick. While this arrangement lends itself to the production of both drum and cymbal sounds during performance because of the common technique for playing both cymbals and drums, there are other types of percussion instruments that are not as easily combined. For instance, a drummer wishing to play both an auxiliary percussion instrument, such as a rattle, and drums and/or cymbals would need to either play the rattle with one hand whilst holding a drum stick with the other hand, or would need to switch hands between a stick and the rattle during performance. This physical limitation restricts the musical expressions that can be produced by the musician.

The inventor has recognized and appreciated that an auxiliary percussion instrument may be attached to a cymbal such that movements of the cymbal produced when the cymbal is struck cause the auxiliary percussion instrument to produce sound, yet without substantially interfering with the natural acoustics of the cymbal. The motion of the cymbal moves the auxiliary percussion instrument via their physical coupling, which in turn can produce sound from the auxiliary percussion instrument concurrently with any sound produced by the cymbal.

The inventor has further recognized and appreciated that attaching an auxiliary percussion instrument to a cymbal via mechanical means may be inconvenient and may negatively affect sound produced by the cymbal. Mechanical fasteners may require that a suitable hole is formed within the cymbal so that that the fastener can securely attach an auxiliary percussion instrument to the cymbal body. Making such a hole in a cymbal can negatively affect the sound quality of the cymbal since vibrational modes of the cymbal that lead to a desired sound may be disrupted, thereby altering the sound produced by a strike of the cymbal. Moreover, making a hole in a cymbal both irrevocably alters the cymbal and limits use of an auxiliary percussion instrument to only the location where the hole is formed. In some use cases it may be advantageous, for example, to utilize different positions of an auxiliary percussion instrument on a single cymbal, yet mechanical fasteners require that multiple holes be formed for such a configuration. Mechanical clips or other fasteners may exist that do not require structurally altering the cymbal may nonetheless alter the sound produced by a strike of the cymbal by absorbing vibrational energy of the cymbal.

The inventor has recognized and appreciated that magnetic fastening techniques may mitigate the above described problems with mechanical fasteners, since magnetic fastening does not require alteration of a cymbal to which an auxiliary percussion instrument is magnetically fastened, and furthermore allows a pickup to be easily installed, removed and/or moved to a new position on a cymbal.

Accordingly to some embodiments, techniques for magnetically fastening an auxiliary percussion instrument to a cymbal may take advantage of ferromagnetic (or ferrimagnetic) properties of the cymbal. For instance, a cymbal may be formed from a material that exhibits ferromagnetism (e.g., steel, nickel brass) and/or may be coated with a material that exhibits ferromagnetism (e.g., a nickel coating). For example, a magnetic fastener (e.g., comprising a permanent magnet) may readily be attracted to a bronze cymbal having a nickel coating. If the magnetic fastener has a sufficiently strong magnetic field, it may remain in substantially the same location on a cymbal to which it is attached, even after repeated strikes of the cymbal.

According to some embodiments, techniques for magnetically fastening an auxiliary percussion instrument to a cymbal may utilize magnetic components on two sides of a cymbal. Irrespective of whether the cymbal exhibits ferromagnetic properties, magnetic components may be placed, for instance, on an upper and lower side of a cymbal. Attraction of the magnetic components to one another through the cymbal may provide sufficient force to keep the magnetic components substantially in place after repeated strikes of the cymbal, even if the cymbal itself does not exhibit ferromagnetism. If the cymbal does exhibit ferromagnetism (or ferrimagnetism), use of magnetic components on two sides of a cymbal may provide further coupling by producing attractive forces between the two magnetic components to one another and between each of the magnetic components and the cymbal.

According to some embodiments, an auxiliary percussion instrument may be coupled to a magnetic component. As described above, one or more magnetic components may produce a force sufficient to hold the component(s) substantially in place on a cymbal, even after repeated strikes of the cymbal. An auxiliary percussion instrument may be coupled to any of such magnetic components in any suitable way, such as by mechanically attaching the auxiliary percussion instrument to a magnetic component, by adhering the auxiliary percussion instrument to the magnetic component (e.g., using a glue or other adhesive), and/or by utilizing an auxiliary percussion instrument that exhibits ferromagnetism (or ferrimagnetism) such that the auxiliary percussion instrument is held in contact with the magnetic component due to a magnetic attraction between the two. In some embodiments, the auxiliary percussion instrument may be attached to a frame housing one or more magnetic components such that the instrument is coupled to the magnetic component(s) via the frame structure. In some implementations the frame may encapsulate one or more magnetic components.

According to some embodiments, an auxiliary percussion instrument may be magnetically coupled to a cymbal using one or more magnetic components that produce a sufficiently strong force that the auxiliary percussion instrument remains coupled to the cymbal after the cymbal is struck. As discussed above, the combined force produced by the magnetic components (between themselves and/or between themselves and the cymbal) should be sufficient to hold the magnetic components substantially in place on the cymbal after repeated strikes of the cymbal. A sufficiently strong magnetic field of the magnetic components must therefore be selected to ensure this occurs. In particular, the inventor has found that rare-earth permanent magnets provide a sufficiently high magnetic field strength that an auxiliary percussion instrument may be attached to a cymbal using this type of permanent magnet.

As used herein, a "magnetic component" of a magnetic fastener may include any permanently magnetic materials, including materials commonly referred to as "permanent magnets." Since magnetic fasteners as described herein utilize magnetic components to produce forces between one or more pairs of magnetic components and/or forces between a cymbal and one or more magnetic components, a magnetic component should be a component capable of sustaining a magnetic field sufficiently strong to provide fastening and to remain substantially in contact with the cymbal and/or an auxiliary percussion instrument and/or another magnetic component after repeated strikes of the cymbal. Illustrative materials suitable for use as a magnetic component include, but are not limited to, ferrite magnets, ceramic magnets, rare-earth magnets, alnico magnets, electromagnets, or combinations thereof.

Following below are more detailed descriptions of various concepts related to, and embodiments of, systems and methods for magnetically mounting an auxiliary percussion instrument to a cymbal. It should be appreciated that various aspects described herein may be implemented in any of numerous ways. Examples of specific implementations are provided herein for illustrative purposes only. In addition, the various aspects described in the embodiments below may be used alone or in any combination, and are not limited to the combinations explicitly described herein.

Although particular shapes and sizes of cymbals are described and shown herein, it is envisioned that the functionality of the various disclosed techniques for magnetically mounting an auxiliary percussion instrument may be applied to any type of instrument that has a metallic surface, which is not necessarily limited to cymbals. For instance, the techniques described herein may be utilized with a cymbal of any size, shape or type, such as, but not limited to, cymbals commonly known as a ride, a crash, a hi-hat, a crash/ride, a splash, a China cymbal, and/or a marching cymbal. It will be appreciated that cymbal types, including those indicated above, may be formed in a variety of shapes and sizes, and that the types indicated are broad categorizations known to those of skill in the art.

FIG. 1 depicts a cross-section of an illustrative cymbal suitable for practicing some embodiments. Cymbal 100 includes cymbal body 101 and may also include an optional coating. Cymbal body 101 may be of any suitable shape, though in some embodiments may include a bell or "cup" region in the center of the cymbal and/or a "bow" region around the exterior of the cymbal, both of which are indicated in the example of FIG. 1. It should be appreciated that in general, cymbals discussed herein may be of any suitable size and/or shape, though may in some embodiments have the general form shown in FIG. 1. The specific dimensions of each region may be of any suitable size, both in terms of absolute sizes and relative sizes. For example, a cymbal having a small or negligible cup region may be used with embodiments described herein.

Cymbal body 101 may comprise any suitable material, or combination of materials. In some embodiments, cymbal body 101 is constructed from a material that is suitably rigid so as to produce sounds when struck and/or has a hardness such that repeated strikes of the cymbal will not significantly dent or damage the material. In some embodiments, cymbal body 101 comprises a metal. In some embodiments, cymbal body 101 comprises bronze, which may include any formulation of a bronze alloy comprising any proportions of copper and tin in addition to any number and any type of other substances. Suitable bronze alloys may include, but are not limited to, 92% copper and 8% tin alloys (commonly known as "B8"), 80% copper and 20% tin alloys (commonly known as "B20"), Paiste Sound Alloy, bronze comprising between 70% copper and 100% copper by volume and/or by weight, bronze comprising between 0% and 30% tin by volume and/or by weight, bronze comprising silver, and/or any combinations thereof.

Cymbal body 101 may be of any suitable size and/or shape. In the example of FIG. 1, cymbal body 101 is circular when viewed from above and has a cross-section including the bow and cup regions shown. However, cymbal body 101 is not limited to cymbals that have this particular shape or cross-section, and it will be appreciated that the particular shape of cymbal depicted in FIG. 1 is provided merely as an example. Moreover, cymbal body 101 may be of any suitable size, including diameters between 6 inches and 30 inches, and thicknesses between 1 mm and 10 mm. However, cymbal body 101 may also be a vertically mounted gong, for example, and have a diameter between 1 foot and 6 feet.

In some embodiments, cymbal 100 may include an optional coating. Such a coating may comprise any resilient material, such as a resilient material having a hardness between 20 and 500 on the Brinell scale; a resilient material having a tensile strength between 50 MPa and 1000 MPa; a resilient material having a modulus of elasticity between 100 MPa and 100 GPa; and/or a resilient material having a compressive yield strength between 50 MPa and 2000 MPa.

An optional coating may be of any suitable thickness. For example, the coating may have a thickness between 1 μm and 10 mm; for example between 1 mm and 5 mm. A coating may have a homogeneous thickness across an area of cymbal body 101 to which it is applied, though may alternatively, or additionally, have a thickness that varies across the cymbal. For example, a coating may have a greater thickness toward an exterior circumference of cymbal body 101 than a thickness at or close to the center of cymbal body 101. Where a coating comprises multiple components and/or materials, each component and/or material may have any suitable thickness or thicknesses.

In some embodiments, cymbal 101 has a coating that comprises a metal. For example, the coating may comprise a metal plated to cymbal body 101 and/or to another component of the coating. In some embodiments, a coating may comprise a powder coating, polytetrafluorethylene (PTFE), one or more anodized materials, or combinations thereof. A coating may be applied to cymbal body 101 via any suitable technique or techniques. A coating may comprise multiple layers and/or multiple materials which may be applied to cymbal body 101 in sequence, and/or may be combined separately and then applied to cymbal body 101.

In some embodiments, a coating of cymbal 101 comprises a first layer which dampens vibrations of cymbal body 101 and a second layer applied over at least part of the first layer, which further dampens vibrations of cymbal body 101, and which may also provide a protective coating. For example, the coating may comprise an ink applied to the surface of cymbal body 101 and an elastomeric coating applied over the ink. Since some components of the coating may provide desirable dampening qualities but may be damaged or otherwise degraded upon repeated strikes of cymbal 100, in some use cases in may be beneficial to include a protective component in the coating that can be substantially undamaged by repeated strikes. For example, any one or more of the resilient qualities discussed above (high hardness, etc.) may be utilized in such a protective coating.

Cymbal 100 may produce different types of sound depending on where it is struck. While there are essentially infinite variations in the types of sound, for musical purposes cymbal strikes may be divided into at least three broad categories, including "bell", "bow", and "edge" strikes. Bell strikes are achieved by striking the cymbal near its center, on or around the bell or "cup" region. Bow strikes are achieved by striking the main body of the cymbal with the tip of a stick. Edge strikes are achieved by striking the edge of the cymbal with the side of a stick's shaft. In addition to the various strike types the cymbal may be silenced by grasping the edge of the cymbal (e.g., with a hand), causing vibrations to cease or to at least be significantly damped. This is referred to as "choking" the cymbal. The various strike types and choking are collectively referred to as the instrument's "articulations."

Figure 2:
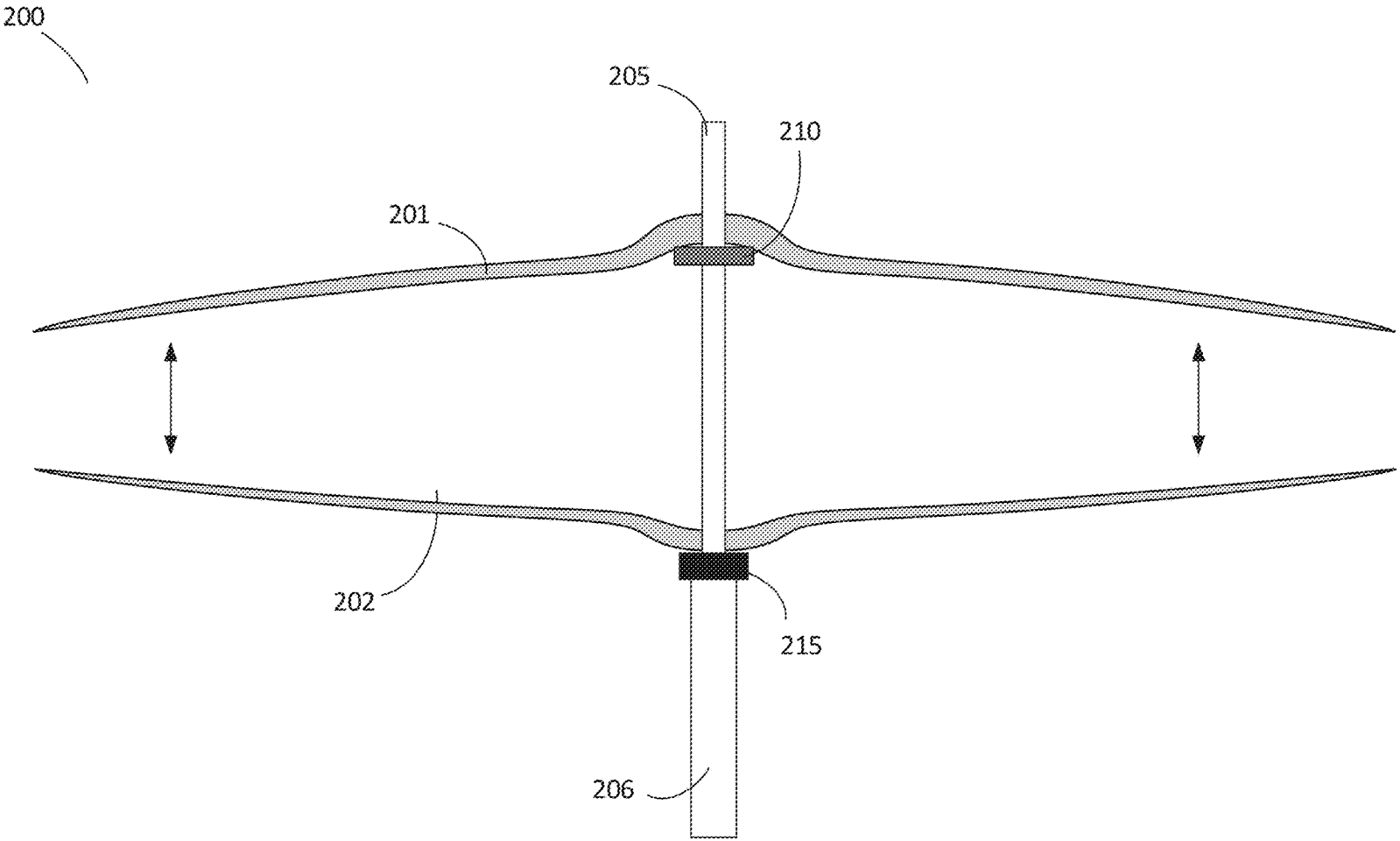
FIG. 2 depicts a cross-section of an illustrative hi-hat cymbal suitable for practicing some embodiments.

FIG. 2 depicts a cross-section of an illustrative hi-hat cymbal suitable for practicing some embodiments. Hi-hat 200 includes an upper cymbal 201 and a lower cymbal 202, one or both of which may be an instance of the cymbal 101 shown in FIG. 1, although in some cases one or both of the upper cymbal and lower cymbal may be a so-called "cupless" cymbal.

In the example of FIG. 2, the upper cymbal 201 is mounted to a rod 205 through a hole disposed in the center of the cymbal and via a collar 210. Rod 205 is free to slide within rod 206, which may be actuated via a foot pedal (not shown). The lower cymbal 202 rests on a collar 215 that is coupled to the rod 206. In operation, the upper cymbal may be raised and lowered relative to the lower cymbal such that it may be in contact with the lower cymbal or situated a distance away from the lower cymbal, as shown in FIG. 2. In this manner, FIG. 2 may represent a situation in which the foot pedal has been depressed, thereby raising upper cymbal 201 above the lower cymbal 202. This configuration allows playing of each cymbal separately by striking each or both when the two are separated, and also allows production of sound by allowing the cymbals to strike each other by depression and release of the foot pedal. Furthermore, the cymbals can be struck while in contact with each other. The hi-hat thereby provides for a wide range of musical expression.

In the illustrative embodiments discussed below, it is envisioned that an auxiliary percussion instrument may be magnetically coupled to any type of cymbal. It may, however, be particularly advantageous to magnetically couple an auxiliary percussion instrument to a hi-hat, such as that depicted in FIG. 2, because the up-down motion of a hi-hat may naturally generate sound from the auxiliary percussion instrument in a manner convenient to a musician as compared with the sound produced by striking a cymbal to which the auxiliary percussion instrument is coupled.

Figure 3:
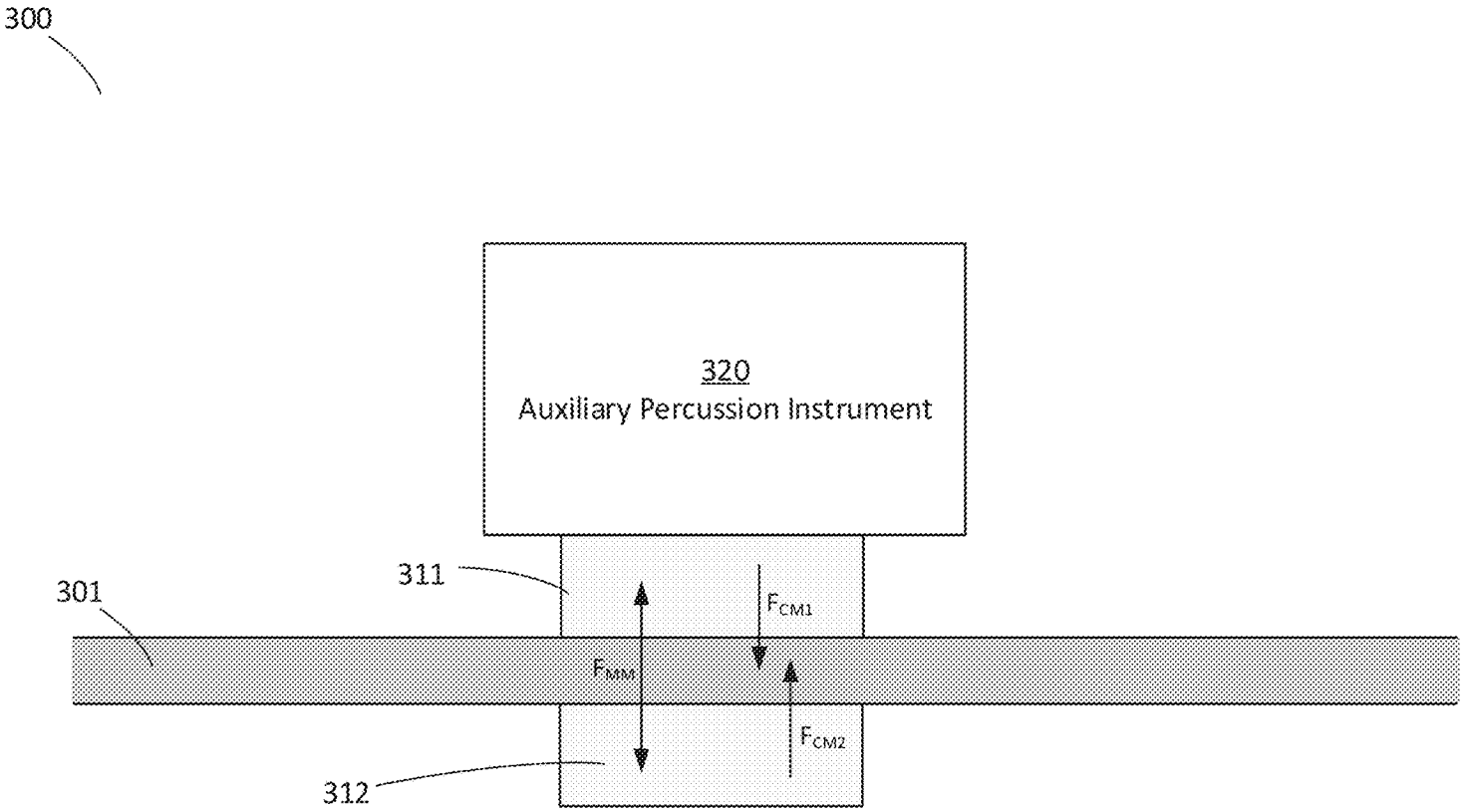
FIG. 3 depicts a cross section of an illustrative cymbal having an auxiliary percussion instrument magnetically mounted to its surface, according to some embodiments.

FIG. 3 depicts a cross section of an illustrative cymbal having an auxiliary percussion instrument magnetically mounted to its surface, according to some embodiments. Cymbal system 300 includes cymbal 301, magnetic components 311 and 312 and auxiliary percussion instrument 320.

According to some embodiments, magnetic components 311 and 312 may each comprise any number of any type of permanent magnets. In some embodiments, magnetic components 311 and/or 312 may each comprise a rare-earth magnet, such as, but not limited to, NdFeB, SmCo, or combinations thereof. In general, however, magnetic components 311 and 312 may each comprise any number of magnetic elements in addition to zero or more non-magnetic elements, such that the ensemble of elements produces a magnetic field. Additionally, or alternatively, system 300 may optionally include non-magnetic materials coupled to either or both of magnetic components 311 and 312 which may include non-magnetic materials located between either or both magnetic components and the cymbal 301. For example, system 300 may comprise a non-magnetic frame structure that contacts cymbal 301 in addition to a magnetic component attached to the frame yet not contacting the cymbal (e.g., in some cases the magnetic component may be encapsulated by the frame). Alternatively, system 300 may comprise a non-magnetic frame structure that contacts cymbal 301 in addition to a magnetic component attached to the frame that also contacts the cymbal. Irrespective of the particular arrangement of frame and magnetic component(s), the combination of frame and magnetic component may be sufficiently magnetic to be mounted to the cymbal via attraction to the cymbal and/or by attraction to another magnetic component.

According to some embodiments, magnetic components 311 and/or 312 may have a surface magnetic field strength (at at least one surface of the component) between 500 gauss and 10,000 gauss, between 1000 gauss and 5000 gauss, between 2000 and 8000 gauss, at least 3000 gauss, or at least 4000 gauss. According to some embodiments, magnetic components 311 and 312 may produce magnetic fields having substantially the same surface strengths and/or maximum field strengths. According to some embodiments, magnetic components 311 and/or 312 may have a maximum energy product between 10 and 60 MegaGaussOersteds (MGOe), such as between 25 and 50 MGOe, such as between 35 and 45 MGOe, such as approximately 42 MGOe. According to some embodiments, magnetic components 311 and/or 312 may have a substantially cylindrical shape with a magnetization direction along the cylindrical axis. In some embodiments, magnetic components 311 and 312 exhibit different magnetic fields, such as different surface field strengths and/or different maximum field strengths.

Cymbal 301 may have any combination of properties described above in regards to cymbal 100 shown in FIG. 1 and/or either or both of cymbals 201 and 202 shown in FIG. 2. In some embodiments, cymbal 301 is a bronze cymbal such that the magnetic attraction between the magnetic components 311 and 312 is produced via their attraction to each other only (since bronze is not generally a ferromagnetic material).

In the example of FIG. 3, however, cymbal 301 exhibits ferromagnetism (e.g., by being formed from, or including a ferromagnetic material within the cymbal body and/or within a coating applied to the cymbal body). As a result, multiple magnetic forces are produced within system 300. These are: $F_{MM}$, a force exerted upon each of the two magnetic components 311 and 312; $F_{CM1}$, a force exerted between the magnetic component 311 and the cymbal 301; and $F_{CM2}$, a force exerted between the magnetic component 312 and the cymbal 301. Magnetic couplings between these components, which depends both on magnetic field strengths produced by magnetic components 311 and 312 and on the extent of the ferromagnetic properties of the cymbal 301, may together cause the combined system to substantially retain its position after repeated strikes of the cymbal. Since the combination of the magnetic components 311 and 312 is coupled to auxiliary percussion instrument 320, the auxiliary percussion instrument also thereby retains its position while moving in concert with the cymbal. Where cymbal 301 is part of a hi-hat cymbal pair, the magnetic coupling may be such that the magnetic components 311 and 312 remain substantially in the same relative cymbal position when the cymbals of the hi-hat are raised and lowered.

In the example of FIG. 3, auxiliary percussion instrument 320 may include any percussion instrument, or portion(s) of a percussion instrument, having at least a first element that does not move relative to the cymbal 301 in addition to one or more second elements that are free to move relative to the one or more first elements to at least some degree, such that the motion of the second elements can cause them to produce sound by striking other elements of the auxiliary percussion instrument. Sound so produced may include sound produced by the second elements striking other instances of the second elements (as in the case of jingles contacting one another) and/or sound produced by the second elements striking instances of the first elements (as in the case of rattles striking a container in which they are held). A non-limiting list of suitable auxiliary percussion instruments may include one or more jingles, rattles, bells, clappers, chimes, or combinations thereof. In some embodiments, what are traditionally considered to be different instruments may simultaneously be magnetically coupled to a cymbal; for example, both jingles and a rattle may be coupled to a single cymbal via the same magnetic components 311 and 312.

Auxiliary percussion instrument 320 may be attached to magnetic component 312 via any suitable means. In some embodiments, auxiliary percussion instrument 320 includes a housing that exhibits ferromagnetism and the auxiliary percussion instrument may be affixed to the magnetic component 312 due to a magnetic attraction between the two. In some embodiments, auxiliary percussion instrument 320 may be attached to the magnetic component 312 via one or more mechanical fasteners and/or via an adhesive. According to some embodiments, a single housing may include both magnetic component 312 and the auxiliary percussion instrument 300 such that the magnetic force of magnetic component 312 is applied to the cymbal 301 through the housing.

As discussed above, a magnetically fastened auxiliary percussion instrument may be easily moved around a cymbal, which may allow a musician latitude to find an ideal location for a desired sound produced by the auxiliary percussion instrument. While FIG. 3 illustrates a particular configuration of magnetic components and an auxiliary percussion instrument, it will be appreciated that other configurations may be equally applicable to magnetic fastening of an auxiliary percussion instrument. For instance, multiple magnetic components may be provided above and/or below the cymbal 301. For example, two magnetic components may be provided above the cymbal and one magnetic component may be provided below the cymbal.

Figure 4A:
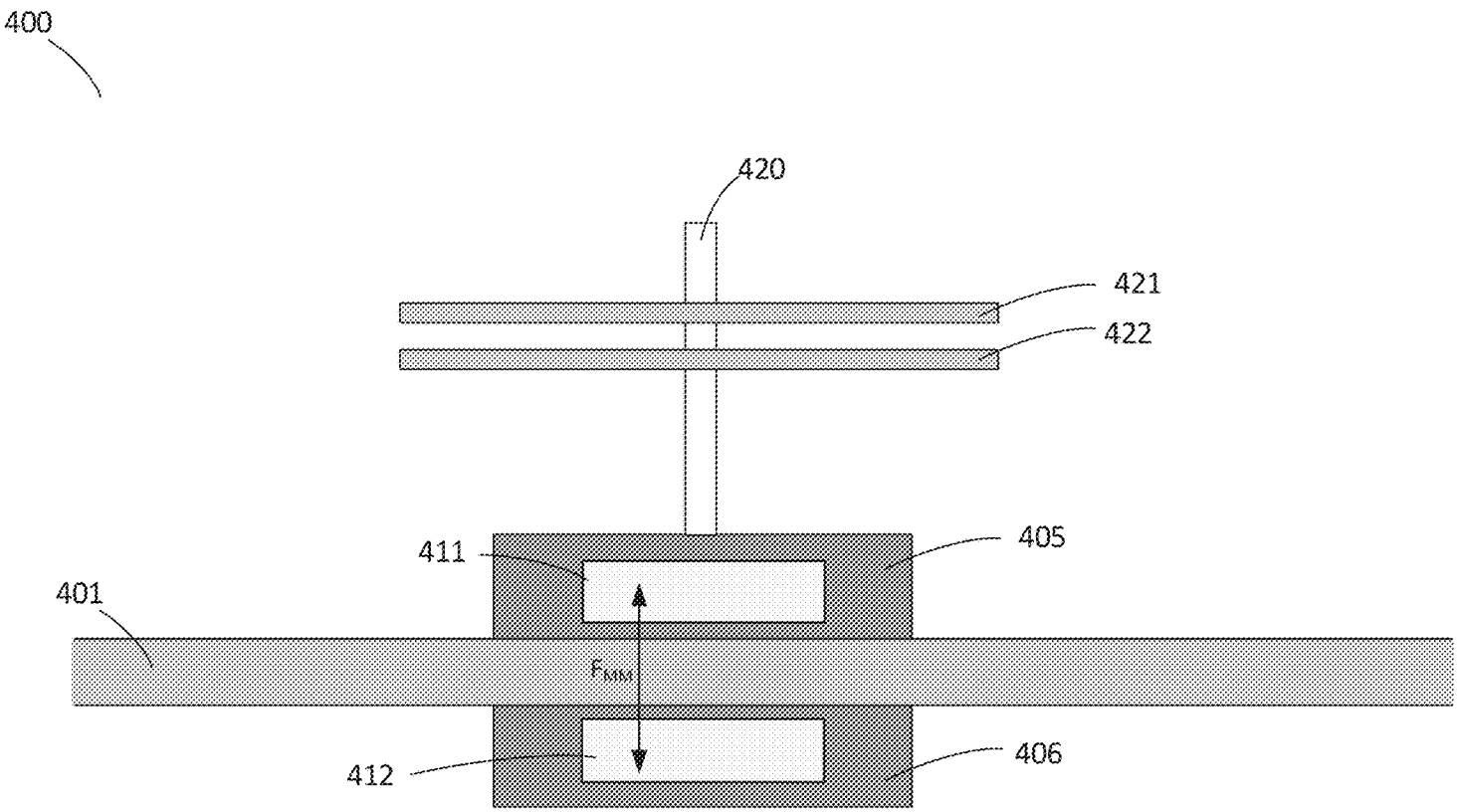
FIG. 4A depicts a cross section of an illustrative cymbal having jingles magnetically mounted to its surface, according to some embodiments.
Figure 4B:
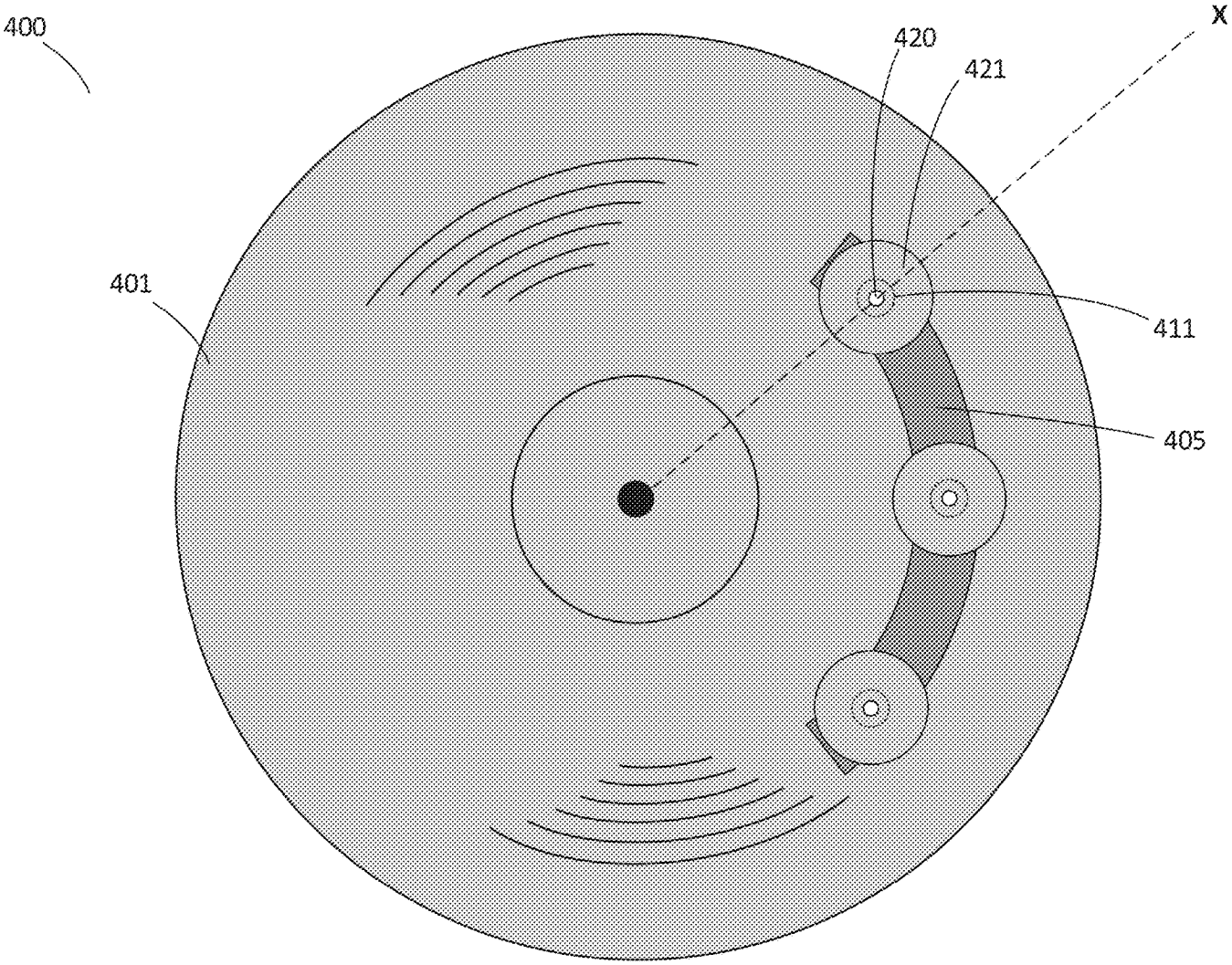
FIG. 4B is a top-down view of the illustrative cymbal depicted in FIG. 4A, according to some embodiments.
Figure 4C:
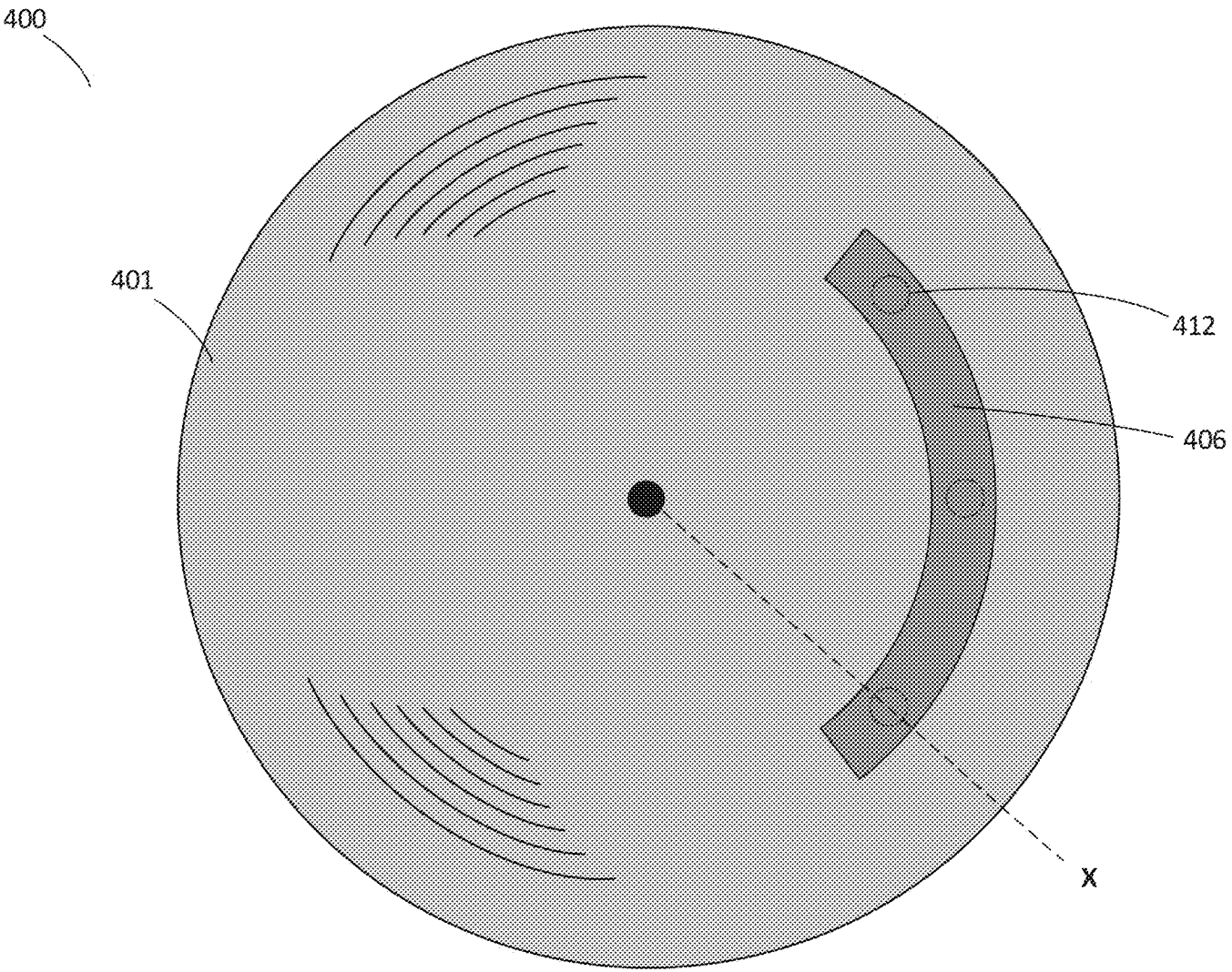
FIG. 4C is a underside view of the illustrative cymbal depicted in FIGS. 4A and 4B, according to some embodiments.

FIG. 4A depicts a cross section of an illustrative cymbal having jingles magnetically mounted to its surface, according to some embodiments. As an illustrative example of system 300 shown in FIG. 3, FIG. 4 depicts system 400 in which jingles 421 and 422 are magnetically coupled to cymbal 401 via magnetic components 411 and 412. FIGS. 4B and 4C are top-down and underside views, respectively, of the illustrative cymbal depicted in FIG. 4A with the cross-sectional axis shown in FIG. 4A depicted as a dashed line with an "X" in FIGS. 4B-4C. The positions of the magnetic components 411 and 412 are shown in FIGS. 4B and 4C, respectively, with dashed circles.

In the example of FIGS. 4A-4C, the cymbal system comprises a frame 405 in which magnetic component 411 is housed and to which a rod 420 is attached. The jingles 421 and 422 are attached to the rod 420 through holes in their center yet are free to tilt around the axis of the rod so that they can collide with one another. For example, the holes in the jingles may be slightly larger than the rod so that there is a limited range of freedom for the jingles to rotate.

Illustrative system 400 also comprises frame 406 in which magnetic component 412 is housed. In the example of FIGS. 4A-4C, the two magnetic components 411 and 412 couple to the cymbal 401 via their mutual magnetic attraction to one another. Motion of the cymbal 401 may cause the two jingles 421 and 422 to collide with one another, producing sound.

According to some embodiments, cymbal 401 may be a standalone cymbal (e.g., a ride cymbal) or may be a cymbal within a hi-hat (e.g., the upper cymbal of a hi-hat). Where cymbal 401 is a cymbal within a hi-hat, the other elements may be sized to ensure they do not impinge upon the other cymbal of the hi-hat. For example, where cymbal 401 is the upper cymbal of a hi-hat, frame 406 may be sized so that it is does not contact the lower cymbal of the hi-hat when the two cymbals are in contact.

According to some embodiments, frame 405 and 406 may be formed from a rigid material, such as polyethylene or another plastic. Rigid materials placed in contact with the cymbal 401 may exhibit less dampening of acoustic vibrations within the cymbal as compared with flexible materials used in the same manner. As such, a rigid plastic frame may be preferable to a silicone frame, which would dampen the acoustic vibrations and thereby negatively impact the sound produced by a strike of the cymbal. It may also be more feasible to mechanically attached the auxiliary percussion instrument to a rigid frame than a flexible frame. In general, however, the frame may be formed from any suitable material and is not limited to being formed from rigid materials.

In some embodiments, one or more washers or other mechanical elements may be included in system 400 to fasten or otherwise hold the jingles 421 and 422 in place. For example, rod 420 may include ridges on its surface on which the washers may sit, thereby holding the jingle in place with respect to its vertical position along the rod.

As will be noted from FIGS. 4B and 4C, in the example of system 400, three pairs of jingles are positioned on a single frame 405, of which jingles 421 and 422 are one pair, and where the frame has an arc shape. A frame 406, having the same shape and magnetic components in the same positions, is located under the cymbal on the opposing side, as shown in FIG. 4C. The arc shape may be beneficial in that it allows for a wide range of placement on the cymbal in addition to providing numerous mounting points for auxiliary percussion instruments, whilst leaving a substantial portion of the cymbal free to be struck by a musician. The presence of the auxiliary percussion instruments when coupled to the cymbal may thereby minimally impact the experience to the musician during performance whilst producing additional sound that may be desirable.

Figure 5:
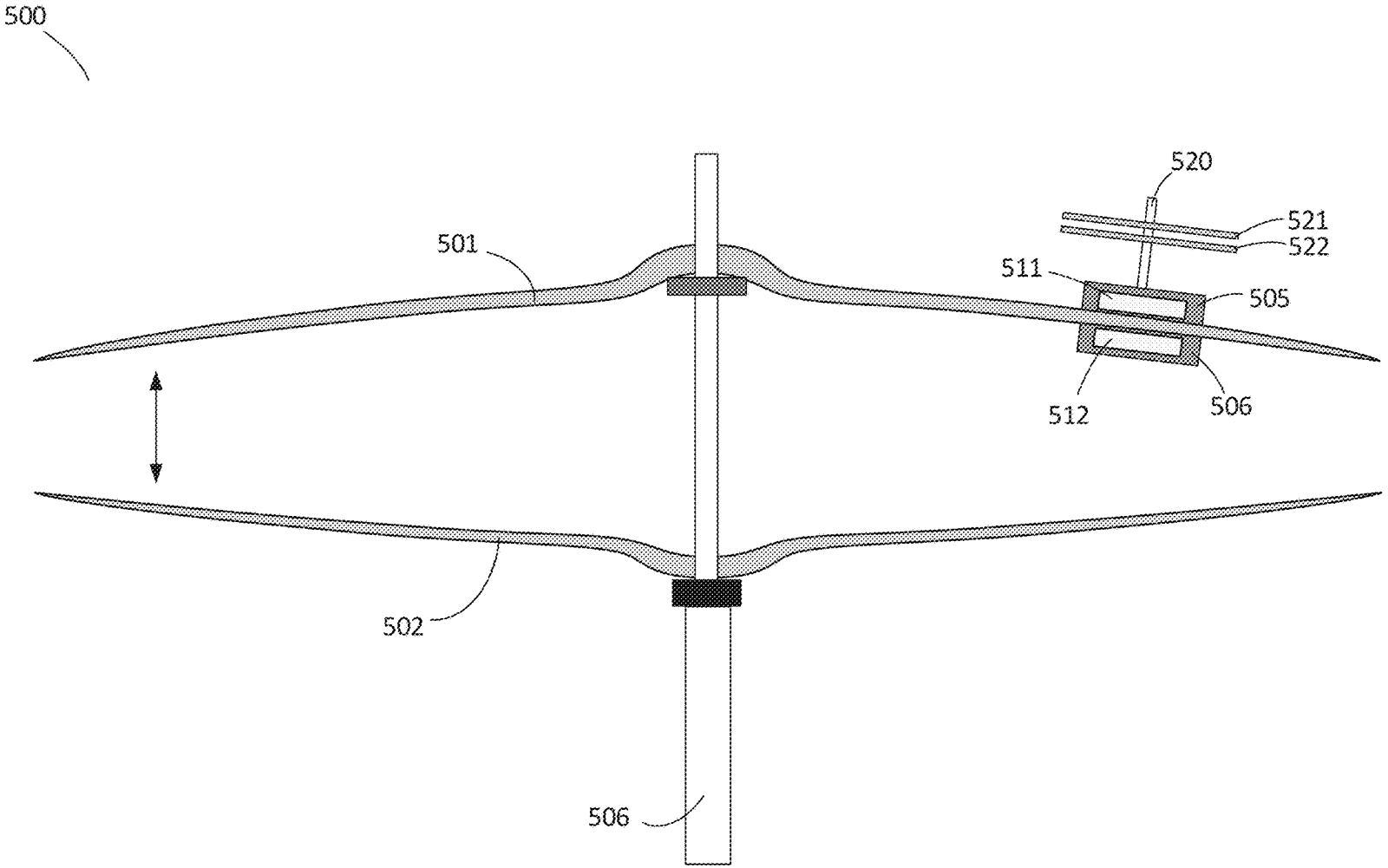
FIG. 5 depicts a cross-section of an illustrative hi-hat cymbal having jingles magnetically mounted to its surface, according to some embodiments.

FIG. 5 depicts a cross-section of an illustrative hi-hat cymbal having jingles magnetically mounted to its surface, according to some embodiments. As discussed above, cymbal system 400 shown in FIGS. 4A-4C may be part of a hi-hat. FIG. 5 illustrates cymbal system 500 that includes a hi-hat and where jingles are magnetically mounted onto the upper cymbal 501 of the hi-hat cymbals 501 and 502. Magnetic components 511 and 512 couple the frames 505 and 506 to one another via their mutual magnetic attraction. Frame 505 is coupled to rod 520 to which the jingles 521 and 522 are attached. When the upper cymbal 501 of the hi-hat is raised and lowered, the jingles may contact one another and thereby produce sound. Motion of the jingles that produces sound may be produced by, for example, the upper cymbal 501 moving towards/away from the lower cymbal 502, the upper cymbal 501 colliding with the lower cymbal 502, strikes of the upper cymbal 501 and/or strikes of the lower cymbal 502 when the upper and lower cymbals are in contact with one another.

Figure 6:
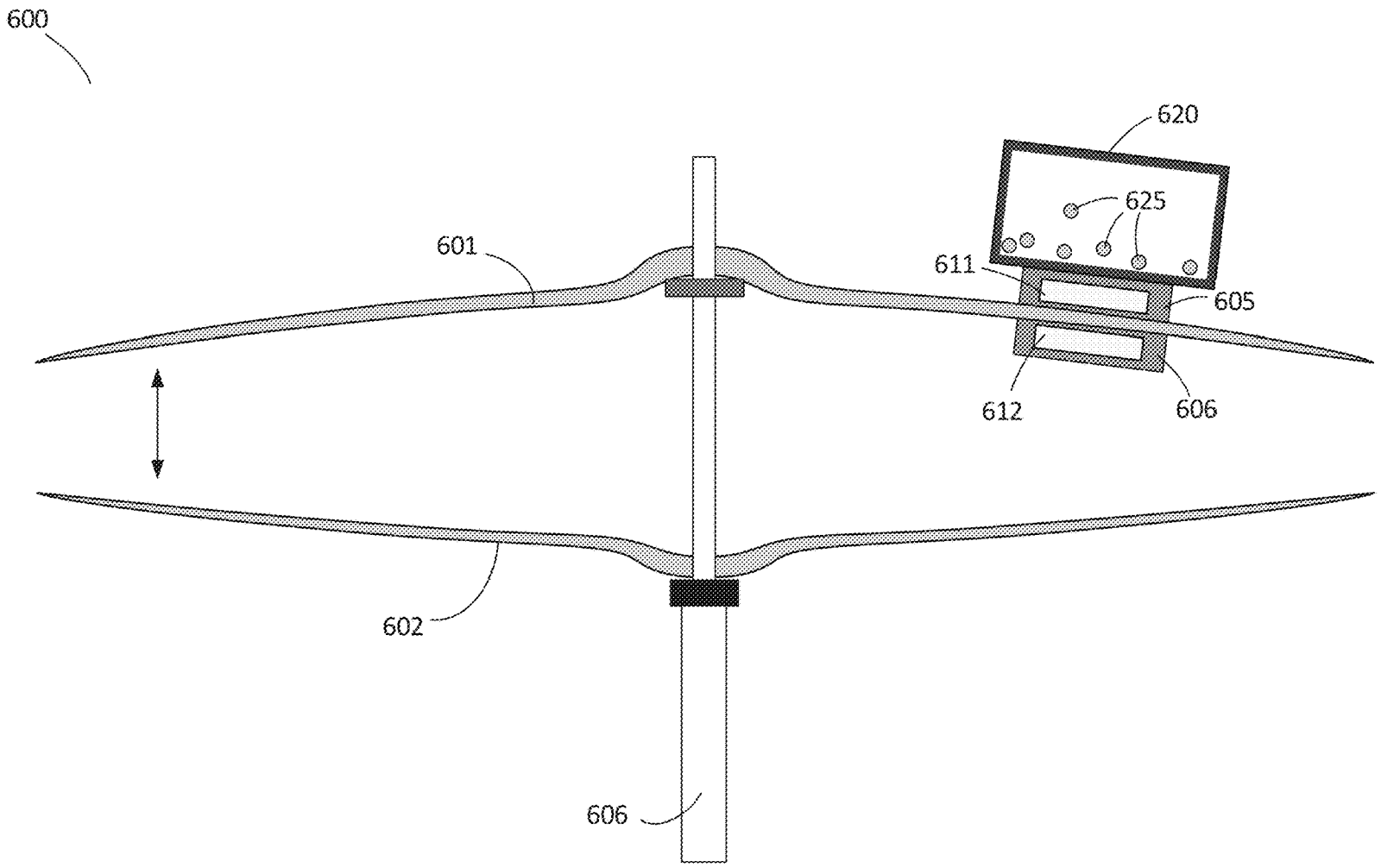
FIG. 6 depicts a cross-section of an illustrative hi-hat cymbal having a rattle magnetically mounted to its surface, according to some embodiments.

FIG. 6 depicts a cross-section of an illustrative hi-hat cymbal having a rattle magnetically mounted to its surface, according to some embodiments. Illustrative system 600 depicts a rattle, being an auxiliary percussion instrument, magnetically coupled to the upper cymbal in a hi-hat. Rattle frame 620 encapsulates a number of balls, of which balls 625 are examples, that are free to move around within the frame. The balls and frame may be made of rigid materials such that sound is produced when the balls and frame collide. Motion of the rattle that produces sound may be produced by, for example, the upper cymbal 601 moving towards/away from the lower cymbal 602, the upper cymbal 601 colliding with the lower cymbal 602, strikes of the upper cymbal 601 and/or strikes of the lower cymbal 602 when the upper and lower cymbals are in contact with one another.

Having thus described several aspects of at least one embodiment of this invention, it is to be appreciated that various alterations, modifications, and improvements will readily occur to those skilled in the art.

Such alterations, modifications, and improvements are intended to be part of this disclosure, and are intended to be within the spirit and scope of the invention. Further, though advantages of the present invention are indicated, it should be appreciated that not every embodiment of the technology described herein will include every described advantage. Some embodiments may not implement any features described as advantageous herein and in some instances one or more of the described features may be implemented to achieve further embodiments. Accordingly, the foregoing description and drawings are by way of example only.

Various aspects of the present invention may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments.

Also, the invention may be embodied as a method. The acts performed as part of the method may be ordered in any suitable way. Accordingly, embodiments may be constructed in which acts are performed in an order different than illustrated or described, which may include performing some acts simultaneously, even though shown as sequential acts in illustrative embodiments.

Use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

What is claimed is:

1. A cymbal system comprising:

a cymbal; and a percussion instrument magnetically coupled to the cymbal, said magnetic coupling between the percussion instrument and the cymbal provided at least in part by:

at least one first magnetic component disposed on a lower side of the cymbal; and at least one second magnetic component disposed on an upper side of the cymbal and attached to the percussion instrument, the at least one first magnetic component and at least one second magnetic component being coupled to the cymbal, at least in part, by a magnetic force of attraction between the at least one first magnetic component and the at least one second magnetic component that acts through the cymbal.

2. The cymbal system of claim 1, wherein the cymbal is a first cymbal and the cymbal system further comprises a second cymbal and a structure to which the first and second cymbals are coupled, the structure being configured to be actuated to move the first cymbal toward or away from the second cymbal.

3. The cymbal system of claim 2, wherein the structure comprises a pedal and clutch.

4. The cymbal system of claim 1, wherein the percussion instrument comprises a first portion and at least one component coupled to the first portion and/or encapsulated by the first portion such that the at least one component is free to move relative to the first portion.

5. The cymbal system of claim 4, wherein the at least one component comprises at least one pair of jingles coupled to the first portion of the percussion instrument.

6. The cymbal system of claim 4, wherein the at least one component comprises a plurality of solid pieces encapsulated by the first portion of the percussion instrument that are each free to move within the first portion.

7. The cymbal system of claim 1, wherein the cymbal includes a plurality of perforations.

8. The cymbal system of claim 1, wherein the cymbal comprises bronze.

9. The cymbal system of claim 1, wherein the first and second magnetic components each comprise a permanent magnet.

10. The cymbal system of claim 9, wherein the permanent magnet has a surface magnetic field strength of at least 3000 gauss.

11. The cymbal system of claim 9, wherein the permanent magnet is a neodymium magnet.

12. The cymbal system of claim 1, wherein the at least one magnetic component on the upper side of the cymbal and the at least one magnetic component on the lower side of the cymbal have substantially the same surface magnetic field strength.

13. A method, comprising:

magnetically coupling a percussion instrument to a cymbal, the magnetic coupling provided at least in part by:

at least one first magnetic component disposed on a lower side of the cymbal; and at least one second magnetic component disposed on an upper side of the cymbal and attached to the percussion instrument, the at least one first magnetic component and at least one second magnetic component being coupled to the cymbal, at least in part, by a magnetic force of attraction between the at least one first magnetic component and the at least one second magnetic component that acts through the cymbal.

14. The method of claim 13, further comprising magnetically coupling one or more additional percussion instruments to the cymbal, thereby magnetically coupling a plurality of percussion instruments to the cymbal, wherein the plurality of percussion instruments are mechanically coupled to a common structure.

15. The method of claim 14, wherein each of the plurality of percussion instruments comprises at least one pair of jingles.

16. The method of claim 13, wherein the cymbal includes a plurality of perforations.

17. The method of claim 13, wherein the cymbal comprises bronze.

18. A magnetically mountable percussion instrument, comprising:

a first portion;

at least one component coupled to the first portion and/or encapsulated by the first portion, the at least one component being free to move relative to the first portion and thereby produce sound by colliding with the first portion and/or others of the at least one component;

at least one first magnetic component coupled to the first portion and having a surface field strength of at least 3000 gauss.

19. The magnetically mountable percussion instrument of claim 18, wherein the at least one first magnetic component is mechanically coupled to the first portion.

20. The magnetically mountable percussion instrument of claim 18, wherein the at least one first magnetic component is magnetically coupled to the first portion.

* * * * *